US006585139B1

(12) United States Patent
Holtmann et al.

(10) Patent No.: US 6,585,139 B1
(45) Date of Patent: Jul. 1, 2003

(54) DRAW ROLLER FOR STRIP MATERIAL

(75) Inventors: Bruno Holtmann, Dielsdorf (CH); Konrad Dessovic, Wallisellen (CH)

(73) Assignee: Achofen + Meier AG Maschinenfabrik, Bulach (CH)

( * ) Notice: Subject to any disclaimer, the term of this patent is extended or adjusted under 35 U.S.C. 154(b) by 0 days.

(21) Appl. No.: 09/807,336

(22) PCT Filed: Sep. 23, 1999

(86) PCT No.: PCT/EP99/07075

§ 371 (c)(1),
(2), (4) Date: Apr. 11, 2001

(87) PCT Pub. No.: WO00/23366

PCT Pub. Date: Apr. 27, 2000

(30) Foreign Application Priority Data

Oct. 16, 1998 (DE) ..... 198 47 799

(51) Int. Cl.[7] ..... B65H 20/00; D21F 3/10
(52) U.S. Cl. ..... 226/95; 162/306; 162/370
(58) Field of Search ..... 226/95; 162/306, 162/360.2, 368, 369, 370, 371

(56) References Cited

U.S. PATENT DOCUMENTS

| | | | | | |
|---|---|---|---|---|---|
| 2,199,455 | A | * | 5/1940 | Berry | 162/370 |
| 2,929,450 | A | * | 3/1960 | Kurz | 162/368 |
| 2,995,186 | A | * | 8/1961 | De Montigny | 162/370 |
| 3,515,637 | A | * | 6/1970 | Reynolds et al. | 162/306 |
| 3,902,960 | A | * | 9/1975 | Zentner et al. | 162/370 |
| 4,838,982 | A | * | 6/1989 | Klaeser et al. | 162/370 |
| 5,020,242 | A | * | 6/1991 | Mayer et al. | 162/370 |
| 5,104,489 | A | * | 4/1992 | Beisswanger et al. | 162/369 |
| 5,230,456 | A | * | 7/1993 | Germann et al. | 226/95 |
| 5,232,141 | A | * | 8/1993 | Mittmeyer et al. | 226/95 |
| 6,328,194 | B1 | * | 12/2001 | Meschenmoser | 226/95 |

FOREIGN PATENT DOCUMENTS

| | | |
|---|---|---|
| DE | 1474973 | 9/1969 |
| DE | 31 00 814 A1 | 7/1982 |
| DE | 34 33 332 A1 | 3/1985 |
| DE | 40 42 168 A1 | 7/1992 |
| EP | 0 427 691 A2 | 5/1991 |
| JP | 05-24726 A1 * | 2/1993 |

* cited by examiner

*Primary Examiner*—Michael R. Mansen
(74) *Attorney, Agent, or Firm*—Herbert Dubno; Andrew Wilford

(57) ABSTRACT

Draw rollers for striplike materials (especially paper or cardboard strips, plastic or metal foils), having a sheath (1) that can rotate around a fixed inner component, whereby said sheath is provided with air holes along the entire surface thereof, are already known per se. A vacuum chamber (8) is arranged in the winding area of the strip. Said vacuum chamber (8) can be subjected to an underpressure. According to the invention, another vacuum chamber (8) is arranged inside the sheath (1) in the running direction of said strip (2) directly in front of the vacuum chamber (8), whereby the underpressure in the second vacuum chamber is greater than the underpressure in the first vacuum chamber (8) and is independent thereof. The upstream second vacuum chamber (8) enables the separating layer of air adhering to the strip (2) to be suctioned in a targeted manner, whereby the contact surface of the strip (2)/roller remains large enough to transmit high drawing forces.

12 Claims, 4 Drawing Sheets

DRAW ROLLER FOR STRIP MATERIAL

CROSS REFERENCE TO RELATED APPLICATIONS

This application is the US national phase of PCT application PCT/EP99/07075 filed Sep. 23, 1999 with a claim to the priority of German patent application 19847799.6 itself filed Oct. 16, 1998.

FIELD OF THE INVENTION

The invention relates to a draw roller for strip or web-shaped materials, in particular for webs of paper or cardboard or foils of plastic or metal, which has a stationary inner part rotatably supporting an outer jacket that is formed over its entire surface with air holes. The interior of the jacket is subdivided into segment-like chambers from which air is pumped in the region engaging the web. The subatmospheric pressure holds the web on the roller so as to increase the holding strength and thus transmit more tension to the web.

BACKGROUND OF THE INVENTION

Preferably such draw rollers are used in systems for making and/or finishing web materials (webs of paper or card-board, foils of plastic or metal) in places where the workpiece can only be gripped on one side, for example because the other side has a layer of liquid coating material (German 1,474,973).

With high web-travel speeds the layer of air between the web and the roller creates problems as the web enters into contact with the roller. An air cushion is created between the web and the roller which holds up the web and thus reduces the contact area. This reduction of the contact area means that less tension can be transmitted. In extreme cases the roller rotates relative to the web.

OBJECT OF THE INVENTION

It is an object of the invention to improve on a draw roller of the above-described type so that even at high web speeds large tensions can be transmitted.

A second object of the invention is to provide a draw roller whose surface can easily be adjusted for different web materials, speeds, and/or web widths.

SUMMARY OF THE INVENTION

This object is achieved in a draw roller for web-shaped materials, in particular for webs of paper or cardboard or foils of plastic or metal, with a stationary inner part rotatably supporting an outer jacket that is formed over its entire surface with air holes, and with a vacuum chamber maintained at subatmospheric pressure in a region of contact with the web wherein inside the jacket relative to the travel direction of the web directly upstream of the vacuum chamber there is a further vacuum chamber which is maintained at a subatmospheric pressure independent of and greater than that of the chamber.

The upstream second;vacuum chamber makes it possible to eliminate the air trapped between the web and the roller so that the contact area remains large in order to transmit the necessary tension.

The second object is achieved in a draw roller for web-shaped materials with a stationary inner part rotatably supporting an outer jacket that is formed over its entire surface with air holes, the inner part having partitions that subdivide the interior of the jacket into chambers of which at least one chamber is connected to a vacuum line, and wherein that the jacket is releasably mounted at both axial ends on annular rotatably supported bearing parts and can be released and drawn axially off the inner part.

BRIEF DESCRIPTION OF THE DRAWING

The drawing serves for describing the invention with reference to a simplified illustrated embodiment.

SPECIFIC DESCRIPTION

Figure 1:
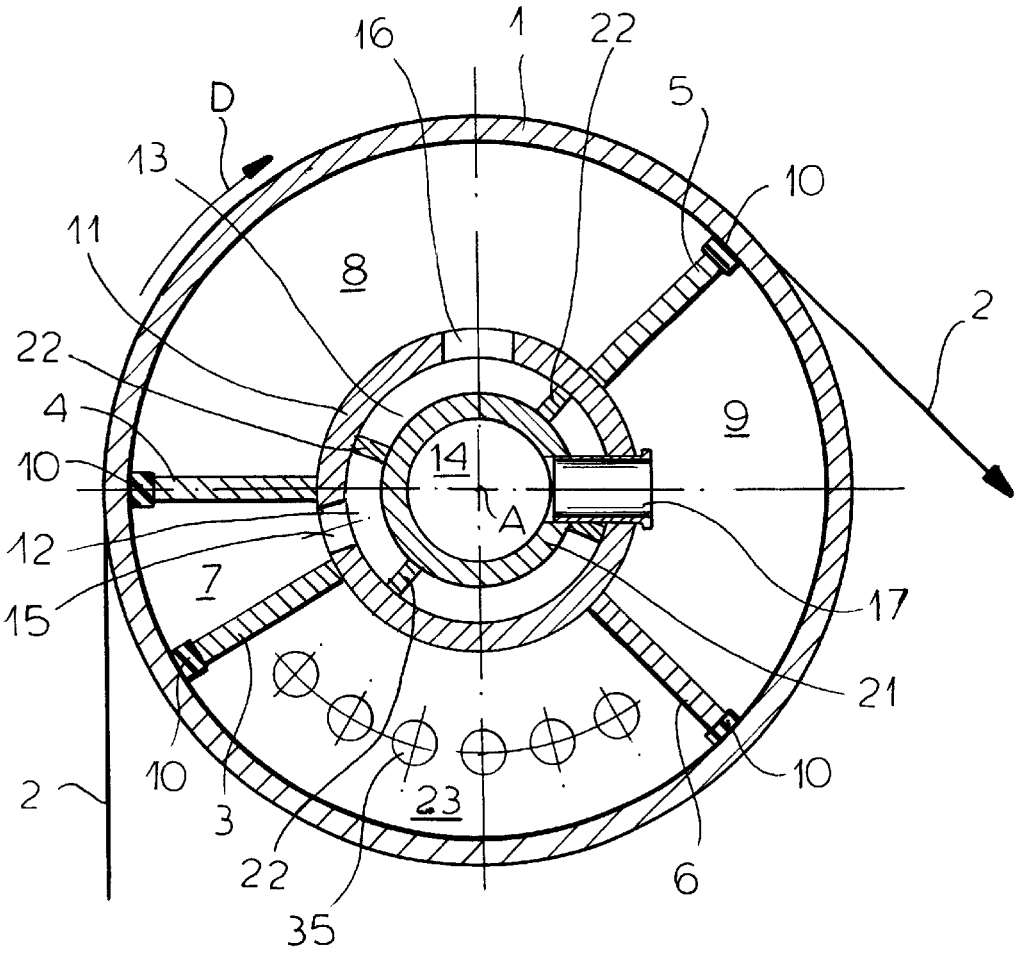
FIG. 1 is a cross section through the draw roller.

The draw roller according to the invention is used in systems for making and/or finishing web-shaped materials (webs of paper or cardboard, foils of metal or plastic) in order to move the web with a accurately defined high speed and/or to give it a predetermined tension while passing through treatment stations. Such stations serve for example for coating, impregnating, surfacing, or laminating or even for making plastic foils. They are used in all treatments in which the web can only be engaged on one side, for example downstream of applicators for coating materials, that is where the coated side cannot be touched. In these treatment regions they serve as a master drive that sets an exact web-travel speed or even as a system for controlling web tension.

The draw roller has a jacket 1 which is rotatably driven and provided over its entire surface with throughgoing air holes. The porosity of the jacket 1 is created by a multiplicity of holes, by manufacture of a porous material, or the like. In addition the outer jacket surface can be provided with a wear-resistant coating of rubber, ceramic, or the like and/or one that increases the friction with the web 2. In order to make air flow between the web 2 and the outer surface uniform and also to avoid marking the web 2, the jacket surface is preferably covered with a plastic or metal mesh. The jacket 1 has a very thin wall of steel, aluminum, or a fiber-reinforced plastic (GFK or GFK laminate) in order to minimize its weight and inertia.

The interior of the jacket 1 is subdivided by radially extending full-length partitions 3, 4, 5, and 6 into chambers 7, 8, and 9 in each of which a respective pressure can be set. The partitions 3, 4, 5, and 6 are part of a normally stationary inner part and have on their radial outer ends friction-free seals 10 extending to the inner surface of the jacket 1. Preferably the inner part is comprised of a tube 11 extending coaxially to the roller axis A and on which the radially outwardly projecting partitions 3, 4, 5, and 6 are fixed and that is subdivided internally into a corresponding number of distribution compartments 12, 13, and 14 that communicate via openings or conduits 15, 16, and 17 with the chambers 7, 8, and 9. The distribution compartments 12, 13, and 14 are connected at one axial end of the tube 11 with respective vacuum or pressure lines 18, 19, and 20 (FIG. 4) in order to set in the chambers 7, 8, and 9 the below-described pressure relationships. In addition the entire inner part is rotatable about the axis A in order to set the position of the segment-shaped chambers 7, 8, and 9 relative to the contact region with the web 2. Preferably this rotation of the inner part is done by a motor M that is operated by a controller C. The controller C positions the inner part according to a predetermined algorithm that takes into account particular physical characteristics of the web 2, for example its porosity, and certain operating parameters, for example the web travel speed.

In this embodiment the distribution chamber 14 is formed by an inner tube 21 coaxial with the outer tube 11 and connected via the short conduit 17 with the chamber 9. The chamber 14 is connected to the pressure line 20 while the distribution chambers 12 and 13 are connected to the vacuum chambers 7 and 8 and to the vacuum lines 18 and 19. The distribution chambers 12 and 13 are formed between the outer tube 11 and the inner tube 21 by partitions 22.

It is significant for the draw roller according to the invention that it have two internal vacuum chambers 7 and 8 whose subatmospheric pressures can be set independently of each other. The two vacuum chambers 7 and 8 are arranged angularly on the roller immediately adjacent each other relative to the rotation direction D of the roller, the upstream vacuum chamber 7 having a greater subatmospheric pressure than the succeeding downstream vacuum chamber 8 which is nonetheless still at subatmospheric pressure. The upstream vacuum chamber 7 has an angular dimension of at least 10°, preferably 20° to 90°, and the downstream vacuum chamber 8 has an angular dimension of at least 20°. Preferably the downstream vacuum chamber 8 has a greater angular dimension than the upstream vacuum chamber 7. The entire suction angle of the two vacuum chambers 7 and 8 is at least as great as the contact angle with the web 2, which is 30° to 240°.

In the preferred embodiment, following the downstream vacuum chamber 8 inside the jacket 1 there is a pressure chamber 9 in which the pressure is superatmospheric. The openings in the jacket 1 in the region of the pressure chamber 9 emit air as a result of the overpressure to encourage separation of the web 2 from the roller. The partition 5 between the vacuum chamber 8 and the pressure chamber 9 extends along an axial line where the web 2 should release from the roller. The interior of the jacket 1 is connected in a chamber 23 between the pressure chamber 9 and the upstream vacuum chamber 7 neither to a pressure line nor to a vacuum line since this chamber 23 is not contacted by the web 2 and does not act on the web 2. At its ends the chamber 23 has throughgoing holes 35 through which air leaks for pressure equalization with the surrounding atmosphere.

Before starting the draw roller the inner part with the partitions 3, 4, 5, and 6 are set such that the upstream vacuum chamber 7 is in the region in which the web 2 and the roller first contact each other. Preferably it is set such that the partition 4 between the two vacuum chambers 7 and 8 is at the desired initial-contact line. The downstream vacuum chamber 8 is so constructed and set that it covers the entire contact area of the web 2. Subsequently the pressure chamber 9 is in the region where the web 2 leaves contact. In use the downstream vacuum chamber 8 in the contact region has a vacuum of between 1 KPa and 20 KPa which depends on the sensitivity of the material and the web-travel speed. In the upstream chamber 7 there is a stronger vacuum. The pressure differential between the two chambers 7 and 8 is at least 0.5 KPa, preferably 1 KPa to 10 KPa. The larger vacuum in the upstream vacuum chamber 7 prevents air from getting trapped between the roller and the web 2. Thus floating of the web 2 on a cushion of air and slipping between the web 2 and roller resulting from reduced contact area is avoided. The thus increased contact area even at high web-travel speeds at the vacuum chamber 8 makes it possible to transmit considerable tension. The independent adjustability of the subatmospheric pressure in the vacuum chamber 7 makes it possible to set this in accordance with web-travel speed so that constant traction relationships are set. Preferably the desired subatmospheric pressure in the upstream chamber 7 is set depending on the web-travel speed and/or web tension by the controller C automatically, for example by a control valve 39 in the feed line 18 for the vacuum chamber 7. Similarly it is advantageously possible by turning the inner part to change the position of the vacuum chamber 7 relative to the passing web 2 dependent on the web-travel speed such that a maximum effective suction angle is set.

Figure 2:
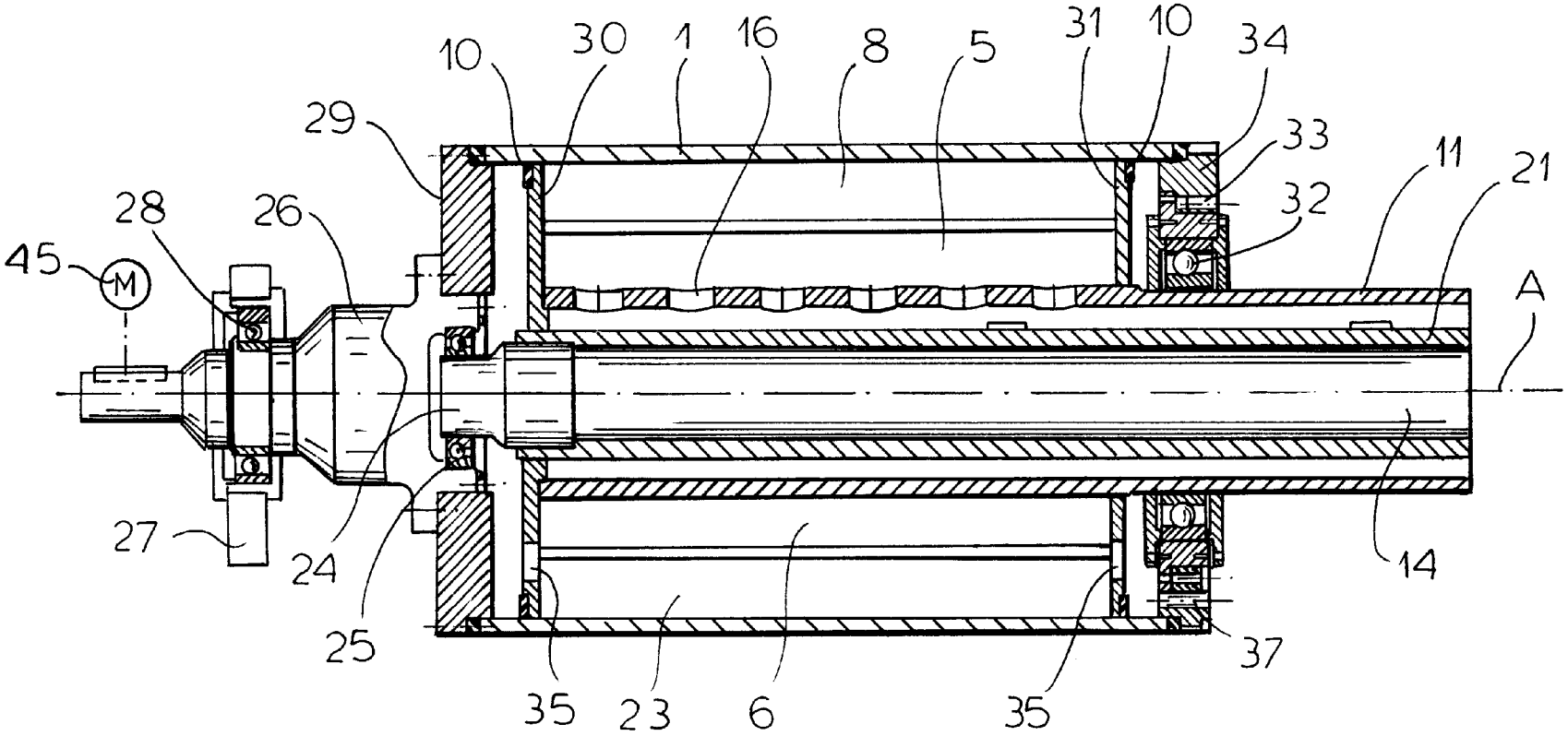
FIG. 2 is a longitudinal section along the rotation axis.

FIG. 2 is a longitudinal section transverse to the web-travel direction through a particularly advantageous embodiment of a draw roller according to the invention. This construction makes it possible to change the jacket very easily in order to accommodate the draw roller to different web materials and/or different web widths. Thus the jacket 1 with the appropriate surface (rubber, ceramic, friction coating, etc) can be specially constructed with a particular air-hole array and/or special air-distributing structures (air-guide grooves, plastic or metal meshes, etc) and/or various widths of suction area for the particular web width.

The inner tube 21 and the outer tube 11 extend at the connection end axially past the end of the jacket 1 and are rotatably mounted at their projecting end in the frame 27 of the machine. The inner tube 21 is there connected to the compressed-air line 20 and the subdivided outer tube 11 to the two vacuum lines 18 and 19. At the opposite driven end the inner tube 21 has a plug or pin 24 closing the pressure chamber 14 and supported by a radial bearing 25 inside a bearing part 26. The bearing part 26 is rotatably mounted in a frame 27 of the apparatus by means of a radial bearing 28 and is connected via a torque-transmitting coupling with a rotary drive 45. The end of the bearing part 26 turned toward the jacket 1 is screwed to the outer periphery of an annular end wall 29 whose outer diameter is the same as that of the jacket 1. The end wall 29 is releasably bolted to the end of the jacket 1.

Inside the roller, pressure-tight regions at both axial ends are defined by respective annular seal walls 30 and 31 that are fixed to the inner part and extend to an inner surface of the jacket 12. The sealing wall 30 on the drive end is secured on the outside of the inner tube 1, the sealing wall 31 on the connection end is on the outside of the outer tube 11. The sealing walls 30 and 31 are also connected in a pressure-tight manner to axial ends of the partitions 3, 4, 5, and 6. The connection end has a bearing 32 rotatably supporting the jacket 1 and having an inner race fixed on the outer tube 11. The outer race is fixed to an annular bearing part 33 over which a second annular end wall 34 is fitted and to which it is releasably bolted. The annular end wall 34 is secured to the connection end of the jacket 1. The end wall 34 also has the throughgoing holes 37 that serve for pressure equalization with the outside in the region between it and the sealing wall 31 and then via the holes 35 into the segment 32 and in the region between the sealing wall 30 and the end wall 29.

Figure 3:
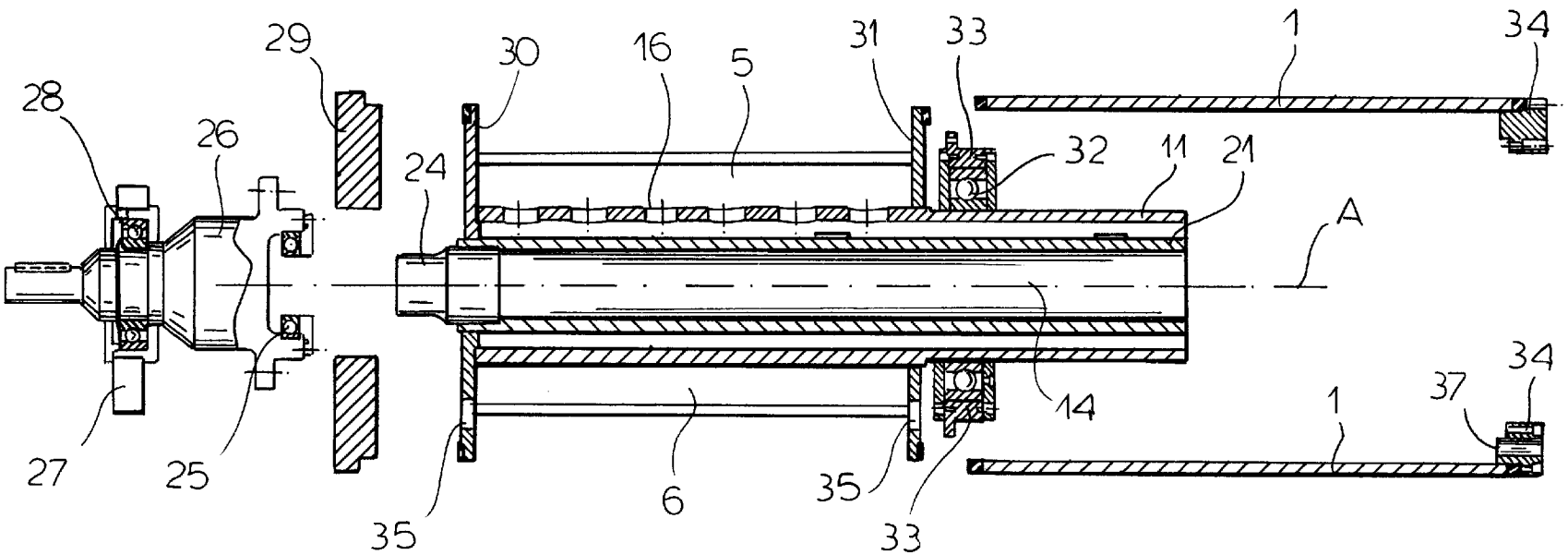
FIG. 3 is an exploded view of the parts.

The above-described setting of the inner part comprised of the tubes 11 and 21, the sealing walls 30 and 31, and the partitions 3, 4, 5, and 6 not shown in FIG. 2 is done in that it is rotated on the bearings 25 and 32 into the necessary position. When in use, the jacket 1 rotates on the two bearings 28 and 32. Changing of the jacket 1 can be done simply as shown in the exploded view of FIG. 3.

The jacket 1 is unbolted on the drive end from the end wall 29 and on the connection end the end wall 34 from the bearing part 33. Then the jacket 1 with the end wall 34 is drawn off axially and switched with a differently constructed jacket 1. The shape of the jacket 1 with the annular end wall 34 as replaceable part has the further advantage that before installation bores can be drilled in the end wall to compensate out any throw.

Figure 4:
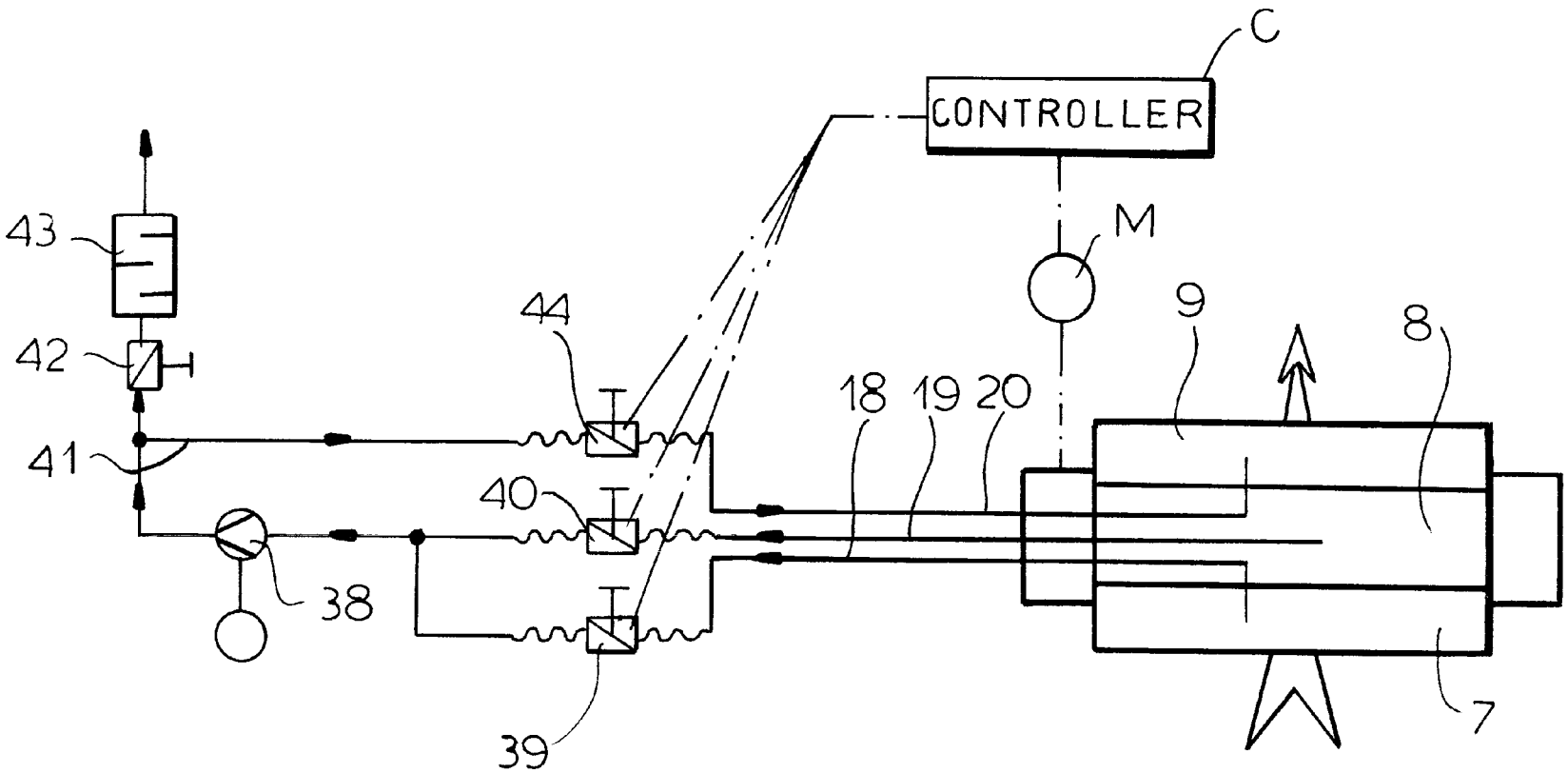
FIG. 4 is a circuit diagram for the elements for setting the required pressure relationships in the individual chambers.

FIG. 4 shows the schematic of the preferred apparatus by means of which the necessary pressure relationships are set in the vacuum chambers 7 and 8 and in the pressure chamber 14. This apparatus needs only a variable-speed blower 38. Alternatively it is possible to connect each vacuum or pressure chamber 7, 8, or 9 via conduits 18, 19, and 20 to respective suction or pressure ports of a blower.

In the embodiment according to FIG. 4 with only one blower 38, each low-pressure line 18 and 19 leading to a vacuum chamber 7 and 8 has a respective adjustable valve 39 or 40 by 15 means of which the necessary pressure in the respective vacuum chamber 7 or 8 can be adjusted. Upstream of the valves 39 and 49 the two vacuum lines 18 and 19 are connected together to the intake of the blower 38. A line 41 connected to the output of the blower 38 has another pressure-regulating valve 42 vented to the outside through a muffler 43. Upstream of the pressure-regulating valve 42 is the connection to the pressure line 41 that leads through a valve 44 to the pressure line 20 for the pressure chamber 9 in order to feed superatmospheric pressure to the pressure chamber 9. The circuit of FIG. 4 makes it possible to set individual and controllable pressures in each of the chamber 7, 8, and 14. Preferably setting the pressure relationships in the individual chambers is done automatically by the controller C which operates the valves 39, 40, 42, and 44 dependent on the web-travel speed and/or the tension in the web.

What is claimed is:

1. A draw roller for advancing a web, the roller having:

a generally nonrotatable inner part;

a cylindrical jacket having a surface centered on an axis, rotatable about the axis on the inner part, and formed over substantially all of the surface with a multiplicity of air holes;

drive means for rotating the jacket about the axis in a rotational direction with the web engaging only a portion of the surface;

partitions inside the jacket on the inner part forming against an inside face of the jacket an upstream vacuum chamber immediately upstream in the direction from the web-engaging portion of the jacket, a pressure chamber immediately downstream in the direction from the web-engaging portion of the jacket, and a downstream vacuum chamber between the up-stream vacuum chamber and the pressure chamber; and blower means for creating subatmospheric pressures in the vacuum chambers with the pressure in the upstream chamber being substantially less than the pressure in the downstream vacuum chamber and for creating a superatmospheric pressure in the pressure chamber, whereby air is evacuated from under the web as it engages the jacket, the web is solidly held by suction against the jacket where it engages the jacket, and the web is pushed by air off the jacket as it separates from the jacket.

2. The draw roller defined in claim 1 wherein the subatmospheric pressure in the upstream vacuum chamber is at least 0.5 KPa greater than the subatmospheric pressure in the downstream vacuum chamber.

3. The draw roller defined in claim 2 wherein the subatmospheric pressure in the upstream vacuum chamber is between 1 KPa and 10 KPa greater than the subatmospheric pressure in the downstream vacuum chamber.

4. The draw roller defined in claim 1 wherein the upstream vacuum chamber has an angular dimension of at least 10°.

5. The draw roller defined in claim 1 wherein the downstream vacuum chamber has an angular dimension of at least 30°.

6. The draw roller defined in claim 1, further comprising:

a pair of annular rings at ends of the jacket; and means releasably securing the rings to the inner part.

7. The draw roller defined in claim 6 wherein the inner part includes an inner tube normally nonrotatable about the axis and having one end carrying one of the rings and attached to the drive means and another end carrying the other of the rings and connected to the blower means.

8. The draw roller defined in claim 7 wherein the inner part includes an outer tube coaxial with the inner tube and having an end connected to the blower means, the tubes each being connected to a respective one of the chambers.

9. The draw roller defined in claim 1 wherein the partitions form inside the jacket an ambient-pressure chamber upstream of the upstream chamber and downstream of the pressure chamber, the ambient-pressure chamber being vented to the atmosphere.

10. The draw roller defined in claim 1 wherein the blower means has an intake and an output and includes respective pressure-regulating valves connecting the vacuum chambers to the intake, the output being connected to the pressure chamber.

11. The draw roller defined in claim 1 further comprising control means connected to the drive means for varying the subatmospheric pressure in the upstream vacuum chamber in accordance with a peripheral speed of the jacket.

12. The draw roller defined in claim 1 further comprising means for limitedly pivoting the inner part and partitions about the axis and for arresting the inner part and partitions in any of a multiplicity of angularly offset positions.

* * * * *